United States Patent [19]

Bewley et al.

[11] 4,324,979

[45] Apr. 13, 1982

[54] VARIABLE NEUTRON COLLIMATOR

[75] Inventors: David K. Bewley, London; Kenneth Finding, Camberley, both of England

[73] Assignee: National Research Development Corporation, London, England

[21] Appl. No.: 50,743

[22] Filed: Jun. 21, 1979

[51] Int. Cl.[3] ..... G21F 5/04

[52] U.S. Cl. ..... 250/505; 250/513; 250/515

[58] Field of Search ..... 250/515, 518, 510, 511, 250/512, 513, 503, 499, 501, 502

[56] References Cited

U.S. PATENT DOCUMENTS 3,995,163 11/1976 Colditz ..... 250/518

4,027,167 5/1977 Pollermann ..... 250/513

*Primary Examiner*—Bruce C. Anderson

*Attorney, Agent, or Firm*—Cushman, Darby & Cushman

[57] ABSTRACT

A variable neutron collimator comprising at least three neutron absorbing blocks spaced from the position of a source of neutrons, each block having a surface remote from said position which is curved and concentric with said position, each block also having a beam-defining face adjacent the direction of the required beam, said faces together defining a polygonal aperture divergent from said position, the thickness of the blocks immediately adjacent each beam-defining face and in the general direction of the beam being sufficient to absorb substantially all neutrons emitted by the source in that direction, and the blocks being rotatable about said position so as to vary the angle of divergence of the aperture.

1 Claim, 3 Drawing Figures

VARIABLE NEUTRON COLLIMATOR

It is often a requirement to provide a beam of neutrons having a limited and closely controlled cross section, for example for medical use. Preferably the beam cross section is easily varied. While continuously-variable collimators for X-rays are known, the absorbing power of lead for X-rays is so great that relatively thin absorbers can be used. By contrast, neutron absorption requires a considerable thickness of metal, e.g. about 40 centimeters of iron for 7 MeV neutrons.

At present, neutron beams are defined by use of sets of solid conical-shaped neutron absorbers fixed in a support. To change the beam cross section, one set of absorbers has to be physically removed and replaced by another set. Since the sets are radioactive after use, special storage facilities are needed. Also, changing the beam size is time-consuming and therefore severely limits the number of patients who can be treated.

It is known that a variable neutron collimator can be provided by limiting each side of a rectangular aperture by a plurality of separate "fingers" of metal which can be independently moved to increase or decrease the aperture and to change its shape, but such an arrangement can only give step-changes of size if integrity is to be maintained, and requires a very complex control system. It is also extremely heavy since each "finger" must be sufficiently thick to provide complete neutron absorption. Since it is expected that in the near future neutron sources, instead of being fixed in position as at present, will be supplied on a gantry to allow free movement of the axial direction of the beam, complexity of control and high weight are undesirable. Yet another disadvantage is that the "fingers" are movable only at right angles to the beam axis and therefore provide not a solid absorbing face along a divergent aperture, but a stepped face of varying interception thickness for the neutrons.

According to the invention a variable neutron collimator comprises at least three neutron absorbing blocks spaced from the position of a source of neutrons, each block having a surface remote from said position which is curved and concentric with said positions, each block also having a beam-defining face adjacent the direction of the required beam, said faces together defining a polygonal aperture divergent from said position, the thickness of the blocks immediately adjacent each beam-defining face and in the general direction of the beam being sufficient to absorb substantially all neutrons emitted by the source in that direction, and the blocks being rotatable about said position so as to vary the angle of divergence of the aperture.

Preferably there are four blocks arranged as two pairs so as to define a square or rectangular aperture, the rotation of one pair being in a plane orthogonal to the plane of rotation of the other pair, both planes being orthogonal to the axis of the divergent aperture. In the fully-closed position of the collimator, the aperture will be parallel-sided, of square or rectangular cross section approximately equal to the area of the neutron source, but in any other position the aperture will be divergent.

Usually the blocks will be of iron, and usually they will be surrounded on their surfaces remote from the neutron beam with a layer of borated polyethylene, which will absorb any neutrons which pass through the blocks and emerge with low energy. The blocks will be suitably supported in a shield intended to absorb neutrons in directions not controlled by the collimator.

It is an advantage of the use of curved neuton absorbing blocks which rotate about the position of the neutron source that the small gaps in the supporting shield, which are needed to allow the collimator to be variable, are generally perpendicular to the axis of the neutron beam. The risk of stray neutrons escaping is thus minimised. Also, since the thickness of the absorbing material in a direction radially outwards from the neutron source is the main consideration, use of blocks having curved outer surfaces reduces the weight of the movable parts.

To further reduce the weight of the rotatable mass, the beam-defining face of one or more blocks may be formed partly by an extension of the block beyond the curved surface. The extension may be integral with or spatially separated from its associated block. It will then be necessary to provide fixed, neutron-absorbing material in directions radial from the neutron source which pass through only the curved surfaces of the block, the sum of the thickness being sufficient to absorb all incident neutrons. The extensions may be slab-shaped.

In yet another arrangement for reducing the weight of the rotatable mass, one or more of the blocks may be of two-component form, each component having a surface remote from the position of the neutron source which is curved and concentric with said position, and each component having a beam-defining face, the sum of the thicknesses of the components adjacent said faces being sufficient to absorb substantially all neutrons emitted by the source.

The invention will now be described by way of example with reference to the accompanying drawings in which.

Figure 1:
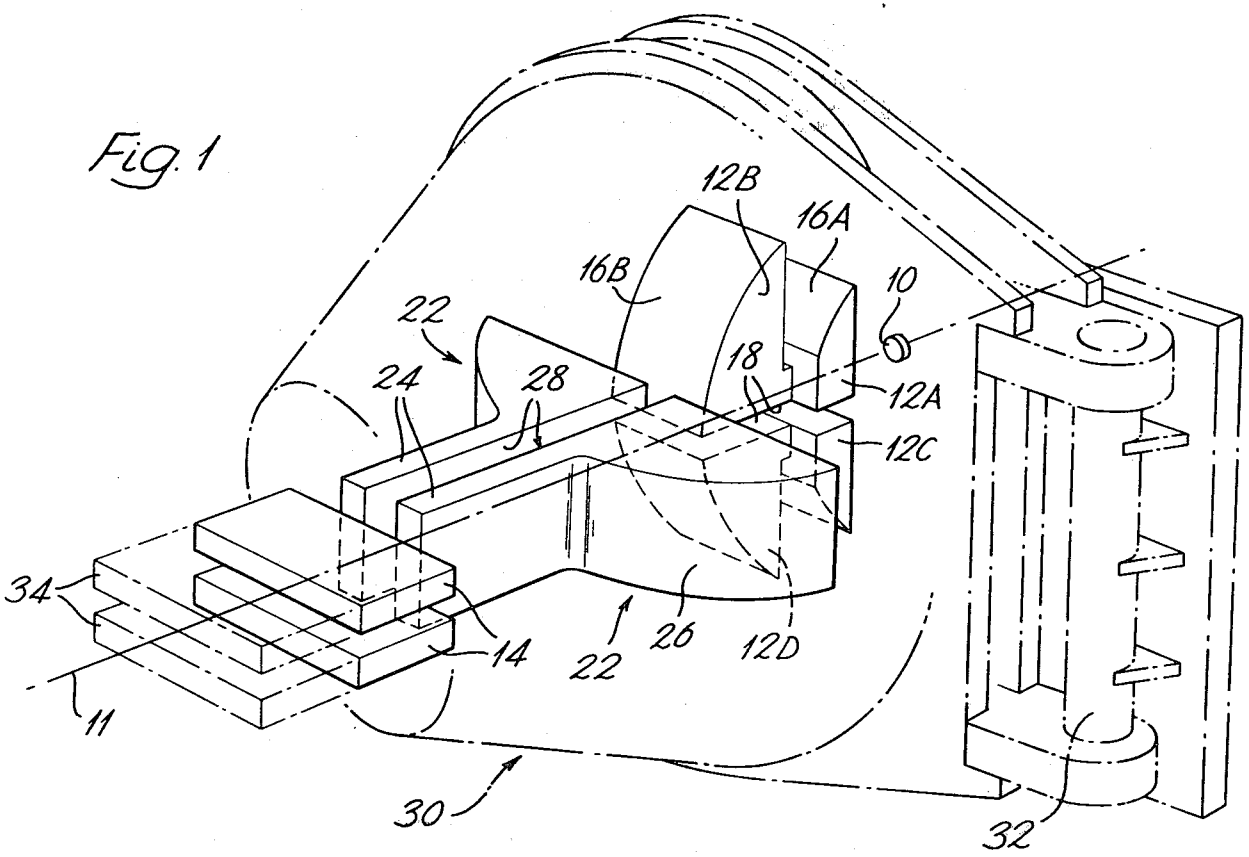
FIG. 1 is a schematic view of a neutron collimator according to the invention.

In FIG. 1, a neutron target is indicated by reference 10. Neutrons are radiated in all directions, and the axial direction of a required neutron beam is shown as reference 11.

Spaced from the target 10 in the direction of the required beam is a first pair of neutron absorbing iron blocks 12 with spatially separated associated slabs 14. Spaced further from the source is a second pair of neutron absorbing iron blocks 22 with integral associated iron slabs 24. A suitable iron is "Armco", (Registered Trade Mark).

Each block 12 of the first pair is a double block comprising two components 12A, 12B and 12C, 12D, each component having a cylindrical surface, such as 16A, 16B, remote from and centred on the target 10. The two components of each block 12 are rigidly fixed together, and each block is rotatable in the vertical plane about the target 10, by means not shown in FIG. 1, so that the concentric relationship with the target 10 is maintained. Each block 12 also has a flat, beam defining face 18 which forms one side of a right quadrilateral aperture through which the beam direction 11 passes. The collimator is shown fully closed; in any other position the aperture is divergent from the target 10. Since the target is of small but definite surface area, the closed collimator forms a parallel-sided aperture of cross section substantially equal to the area of the target, and the divergence is from the edges of the target area.

The pair of iron slabs 14 is also rotatable, by means not shown in FIG. 1, about target 10 and in a vertical plane so that the inner faces of the slabs define the same divergent aperture as the faces 18 of the blocks 12.

The pair of blocks 22 are each formed of a single component. The portions nearer the target 10 have cylindrical surfaces 26 centred on target 10 and the portions further from the target are in the form of slabs 24. The flat inner surfaces 28 of the two portions of each block are continuous and form the other two sides of the right quadrilateral aperture. The blocks 22 are rotatable in a horizontal plane about target 10, keeping the surfaces 26 centred on target 10 and defining the divergent aperture by faces 28.

It will be clear from FIG. 1 that neutrons from the target 10 can pass through the aperture as a beam of square or rectangular cross section. Neutrons emitted radially in directions just adjacent the beam are intercepted by the blocks 12, 22 and their slab extensions 14, 24; the shapes of the blocks and slabs are such that, along radial directions in a cone of greater angle than the required beam, there is sufficient thickness of iron to intercept the large majority of the neutrons emitted by the target 10, except for the central aperture.

While it would be possible to provide the slabs 14 as integral extensions of blocks 12, using a shape similar to the blocks 22 and slabs 24, it is advantageous to place the slabs 14 as close as possible to the end of the collimator to maximise the definition of the beam in the vertical plane.

Neutrons emitted in directions outside the aforementioned cone pass through only the cylindrical parts of the blocks 12, 22, and not through the slabs 14, 24. The path length in iron is insufficient to absorb them and it is therefore necessary to provide a fixed neutron absorbing block 30, of generally conical shape, to absorb neutrons escaping through the blocks 12, 22. The movable parts of the collimator rotate within the fixed block 30. The collimator is hinged at 32 to allow access to the target 10. Sufficient protection must be provided to absorb neutrons which do not pass in the general direction of the collimator.

Preferably the block 30 has an outer layer of borated polyethylene, (not shown separately in FIG. 1) which is a good absorber of low energy neutrons. Also, two polyethylene slabs 34 may be provided, similar to the slabs 14, to improve beam definition.

Figure 2:
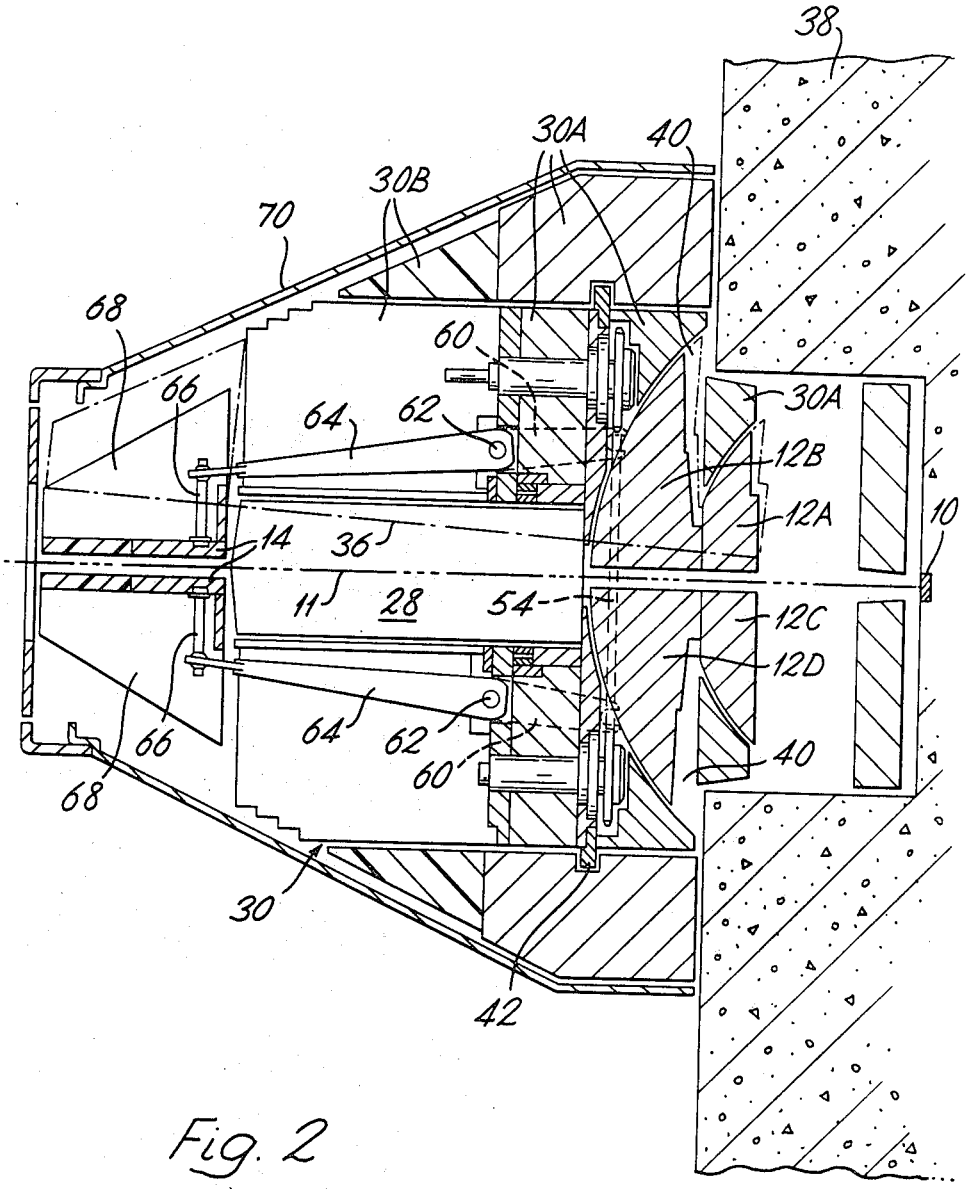
FIG. 2 is a vertical section through the axis of one embodiment of a neutron collimator.

The sectional view in FIG. 2 shows one version of a collimator according to the invention in more detail. The blocks 12 are illustrated, but the blocks 22 lie outside the plane of the section. The blocks 12 are in the fully closed position, but the position of maximum aperture is shown by the chain-dotted line 36; the flat faces 18 of the blocks 12 and the inner faces of the slabs 14 can both lie along the line, and the concentric relation with target 10 of curved surfaces 16, whatever the size of the aperture, is clearly shown.

The fixed block 30 is shown to comprise an iron and polythene portion 30A nearer the target and a borated polyethylene portion 30B remote from the target. It will be seen that in radial directions from the target 10, there is always a considerable thickness of iron, either in blocks 12 plus slabs 14, or in blocks 12 plus iron block 30A. The iron block 30A is supported by a substantial structure 38 which contains shielding material such as concrete and which houses the target 10. The iron block 30A is hinged to the structure 38.

The movable blocks 12 of the collimator rotate within suitably shaped apertures 40 in the fixed block 30. It is clear from FIG. 2 that the direction of the apertures, and the small gap between the fixed and movable blocks, are generally at right angles to the direction of the neutron beam 11. This minimises the risk of escape of energetic neutrons. Further, the use of a two-component block such as 12A, 12B allows the respective gaps in which the components rotate to be smaller than if a single cylindrical block of greater thickness is used. It is another advantage of the rotary movement that, on opening the collimator, the blocks 12 move slightly towards the target 10 so that there is effectively no reduction in shielding. The same advantages apply to the blocks 22.

Figure 3:
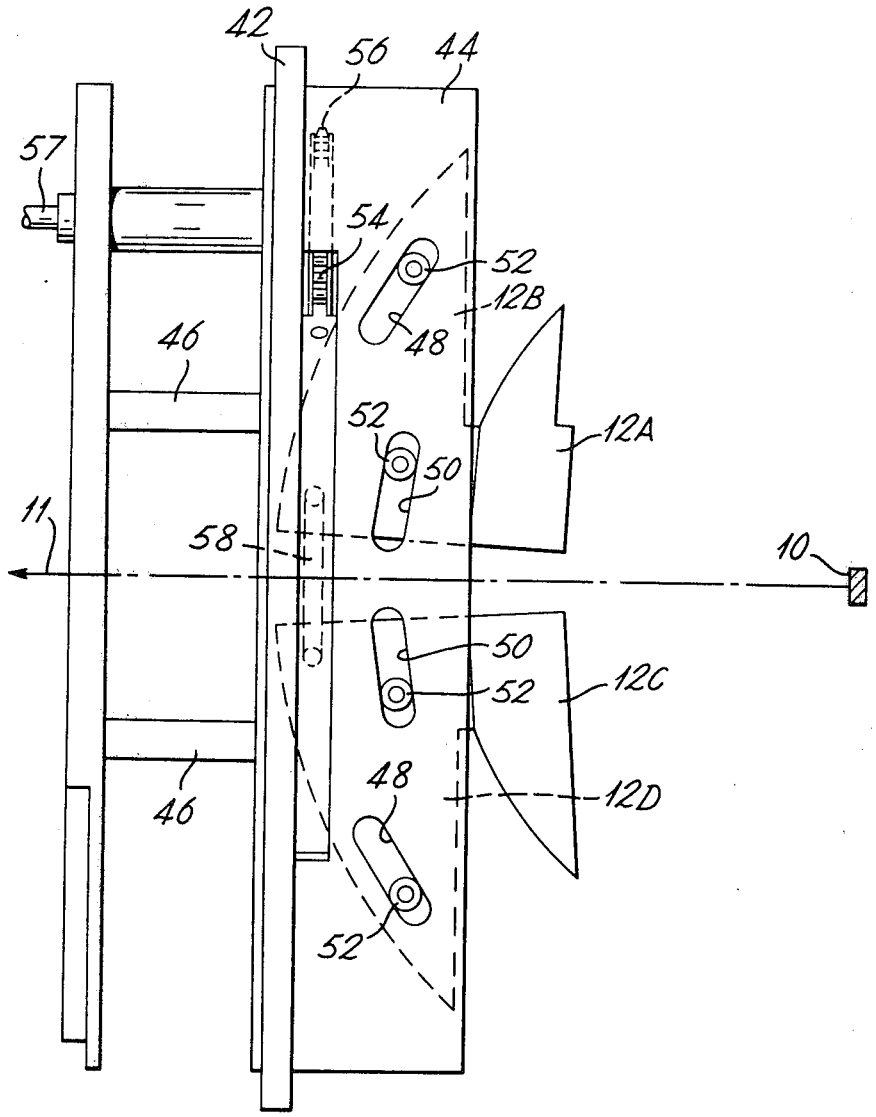
FIG. 3 is a schematic view showing the mechanism causing the rotation of the collimator blocks.

The drive mechanism will now be described briefly with reference to FIGS. 2 and 3.

The weight of blocks 12 is carried by a steel plate 42 which carries two pairs of parallel, spaced support plates 44, 46. Blocks 12 move between support plates 44, only one of which can be seen in FIG. 3, and blocks 22 move between support plates 46. The plates 44 each have four angled slots, each pair of outer slots 48 being at a greater angle to the central axis than the pairs of inner slots 50. Within the slots run support wheels 52 which carry the blocks 12.

The driving forces is provided by an endless chain 54 which runs around sprocket wheels 56 spaced on either side of the collimator axis 11 and rotated by a drive shaft 57 parallel to the axis. Between the sprocket wheels the chain carries on each side a pivoted link bar 58; these bars are pivotally attached respectively to the blocks 12B, 12D. As the chain 54 is moved, the link bars 58 exert a linear pull on the blocks 12 to open or close the gap between them, but the constraint of the wheels 52 in the angled slots 48, 50 is such that the movement is a rotation about the target 10.

The steel plate 42 also allows the whole collimator assembly to rotate about its horizontal axis 11; the movable parts rotate within a cylindrical space in the fixed shielding, (see FIG. 2) and the rectangular aperture can be rotated by e.g. $\pm 50°$.

A similar arrangement (not shown) drives the blocks 22, which also carry borated polyethylene blocks extending outwards to the conical outline shown in FIG. 1.

Referring again to FIG. 2, to provide rotary movement of the slabs 14, fork connections 60, linked one to each side of the chain 54, are connected at fixed pivot points 62 to arms 64 which support the slabs 14 through links 66. The lengths of the connections 60 and arms 62 are chosen so that the movement of slabs maintains their inner surfaces in the required aperture-limiting relationship. The slabs 14 also carry blocks of borated polyethylene 68, equivalent to slabs 34 in FIG. 1. The position of the upper block 68 at maximum aperture of the collimator is shown by a chain-dotted line. The collimator is surrounded by a cosmetic cover 70.

Several variations in the construction of the collimator may be made. The possibility of both blocks having integral slabs has already been referred to. The blocks need not be in pairs, although this is a mechanically simple arrangement. More than four blocks, of single or double form, may be used to give a polygonal aperture.

We claim:

1. A variable neutron collimator comprising two pairs of neutron-absorbing blocks spaced from the position of a source of neutrons, the first pair of blocks being of two-component form, each component having a surface remote from the position of the neutron source which is curved and concentric with said position, each component of each block having a beam-defining face adjacent the direction of the required beam, the faces together defining first opposite sides of a quadrilateral aperture divergent from the position of the source, and a pair of asscoiated extensions of the block spaced from the first pair of blocks in the direction of the beam, the extensions each having a beam-defining face which together also define the same two opposite sides of the divergent aperture; the total thickness of each two-component block and associated extension immediately adjacent the beam-defining face and in the general direction of the beam being sufficient to absorb substantially all neutrons emitted by the source in that direction; the first pair of blocks and the associated extensions being rotatable in a first plane orthogonal to the axis of the divergent aperture so as to vary the angle of divergence of the aperture;

the second pair of blocks each having a surface remote from the position of the neutron source which is curved and concentric with said position, each block having an integral extension beyond the curved surface, each block and integral extension having a continuous beam-defining face adjacent the direction of the required beam, the faces together defining second opposite sides of a quadrilateral aperture divergent from the position of the source; the thickness of the block and extension immediately adjacent the beam-defining face and in the general direction of the beam being sufficient to absorb substantially all neutrons emitted by the source in that direction; the second pair of blocks and integral extensions being rotatable in a second plane orthogonal to the first plane and to the axis of the divergent aperture so as to vary the angle of divergence of the aperture; the second pair of blocks being between the first pair of blocks and the associated extensions;

and a fixed shield of neutron-absorbing material arranged to absorb neutrons travelling in directions radial from the neutron source which pass through only the curved surfaces of any block, the sum of the thicknesses of the block and the shield in directions radial from the source being sufficient to absorb all neutrons emitted by the source in that direction.

* * * * *